US010716399B2

(12) United States Patent
Brown et al.

(10) Patent No.: US 10,716,399 B2
(45) Date of Patent: Jul. 21, 2020

(54) DRAWER ORGANIZER

(71) Applicants: Virginia Flynn Brown, Wichita, KS (US); Barrett Prelogar, Lake Ozark, MO (US)

(72) Inventors: Virginia Flynn Brown, Wichita, KS (US); Barrett Prelogar, Lake Ozark, MO (US)

(73) Assignee: Virginia Flynn Brown, Wichita, KS (US)

( * ) Notice: Subject to any disclaimer, the term of this patent is extended or adjusted under 35 U.S.C. 154(b) by 0 days.

(21) Appl. No.: 14/694,745

(22) Filed: Apr. 23, 2015

(65) Prior Publication Data

US 2015/0305501 A1 Oct. 29, 2015

Related U.S. Application Data

(60) Provisional application No. 61/983,222, filed on Apr. 23, 2014.

(51) Int. Cl.

| | |
|---|---|
| ***A47B 88/90*** | (2017.01) |
| ***A47B 88/994*** | (2017.01) |
| *A47B 88/975* | (2017.01) |

(52) U.S. Cl.

CPC ..... *A47B 88/90* (2017.01); *A47B 88/994* (2017.01); *A47B 88/975* (2017.01)

(58) Field of Classification Search

CPC ..... A47B 88/20; A47B 2088/202; A47B 2088/205; A47B 2088/207; A47B 47/066; A47B 47/0075; A47B 47/042; A47B 88/969; A47B 88/975; A47B 88/994; B65D 25/04; B65D 25/06

USPC ..... 220/533, 532, 529; 312/348.3

See application file for complete search history.

(56) References Cited

U.S. PATENT DOCUMENTS

| | | | | |
|---|---|---|---|---|
| 56,237 A | | 6/1896 | Booz | |
| 1,747,390 A | * | 2/1930 | Robb | A47B 88/90 217/23 |
| 1,995,335 A | | 6/1933 | Wilke | |
| 2,257,536 A | | 2/1938 | Roycroft | |

(Continued)

FOREIGN PATENT DOCUMENTS

| | | | | |
|---|---|---|---|---|
| CH | 683815 A5 | * | 5/1994 | A45C 5/02 |
| FR | 2303722 A1 | * | 10/1976 | A47B 88/975 |

(Continued)

*Primary Examiner* — Andrew M Roersma

(74) *Attorney, Agent, or Firm* — Kenneth H. Jack; Davis & Jack, L.L.C.

(57) ABSTRACT

A drawer organizer that is easily customizable and that is configured for simple packaging as a kit. The drawer organizer includes a base and a plurality of partitions formed from a flexible material having a grid or waffle configuration that provides a plurality of grid spaces therein and a plurality of tabs along portions of the perimeters of the base and partitions. Connector assemblies are provided to retain the partitions at junctions therebetween. The connector assemblies include an inside corner piece and a pair of locking plates. The corner piece engages grid spaces in the intersecting partitions. The locking plates engage the corner pieces to capture the partitions therebetween. The drawer organizer can be provided as a kit in a rolled up tubular form in which all components thereof are rolled together.

6 Claims, 7 Drawing Sheets

(56) References Cited

U.S. PATENT DOCUMENTS

| | | | | | |
|---|---|---|---|---|---|
| 2,218,300 | A | * | 10/1940 | Schuster | 220/8 |
| 2,884,154 | A | | 8/1956 | Hobson | |
| 2,800,223 | A | * | 7/1957 | Firlit | 206/494 |
| 2,945,732 | A | * | 7/1960 | Edmondson, Jr. | A47B 88/90 312/140.3 |
| 3,497,081 | A | * | 2/1970 | Field | A47F 5/005 211/184 |
| 3,656,786 | A | * | 4/1972 | Larson | A47F 3/12 217/5 |
| 4,305,629 | A | | 12/1981 | Friis | |
| 4,421,366 | A | * | 12/1983 | Niziol | 312/265.6 |
| 4,444,321 | A | * | 4/1984 | Carlstrom | 211/186 |
| 4,517,231 | A | * | 5/1985 | May et al. | 428/36.92 |
| 4,595,246 | A | | 6/1986 | Bross | |
| 4,627,595 | A | | 12/1986 | Rhodes et al. | |
| 4,675,970 | A | | 6/1987 | Galen | |
| 4,693,382 | A | | 9/1987 | Galen | |
| 4,768,661 | A | * | 9/1988 | Pfeifer | A47F 5/005 211/184 |
| 4,899,928 | A | | 2/1990 | Korff | |
| 4,940,156 | A | | 7/1990 | Cote et al. | |
| 5,148,932 | A | * | 9/1992 | Orefice | 220/23.2 |
| 5,211,458 | A | * | 5/1993 | Yale | 312/193 |
| 5,242,223 | A | | 9/1993 | Koves | |
| 5,441,709 | A | * | 8/1995 | Berry, Jr. | 422/297 |
| 5,553,710 | A | | 9/1996 | Takama | |
| 5,664,856 | A | | 9/1997 | Pacetti | |
| 6,129,219 | A | * | 10/2000 | Peickert | 211/74 |
| 6,493,917 | B1 | * | 12/2002 | Sunka | A47B 88/994 29/413 |
| 6,634,728 | B1 | * | 10/2003 | Leguin | 312/348.3 |
| 7,121,407 | B2 | | 10/2006 | Hurt et al. | |
| 7,246,704 | B2 | * | 7/2007 | Brunson et al. | 206/372 |
| 7,380,894 | B2 | * | 6/2008 | Berger | A47B 88/994 312/348.3 |
| 7,424,958 | B1 | * | 9/2008 | Eley | B25H 3/04 211/70.6 |
| 7,703,866 | B2 | * | 4/2010 | Benz | F25D 25/02 211/184 |
| 8,397,937 | B2 | | 3/2013 | Preschke et al. | |
| 8,628,155 | B1 | * | 1/2014 | Nielson | 312/212 |
| 2001/0035385 | A1 | | 11/2001 | Sosso | |
| 2002/0179556 | A1 | * | 12/2002 | Osawa | 211/184 |
| 2003/0184199 | A1 | * | 10/2003 | Jananji | A47B 88/975 312/348.3 |
| 2008/0083753 | A1 | * | 4/2008 | Escobar et al. | 220/8 |
| 2012/0205335 | A1 | | 8/2012 | Abdullahi | |
| 2012/0205415 | A1 | | 8/2012 | Abdullahi | |
| 2012/0319550 | A1 | | 12/2012 | Manniso et al. | |
| 2014/0190640 | A1 | * | 7/2014 | Maltais | A47B 88/90 160/113 |

FOREIGN PATENT DOCUMENTS

| | | | | | |
|---|---|---|---|---|---|
| GB | 2134884 | A | * | 8/1984 | B65D 25/06 |
| WO | WO 2011048573 | A1 | * | 4/2011 | A47B 88/20 |

* cited by examiner

DRAWER ORGANIZER

CROSS-REFERENCE TO RELATED APPLICATIONS

This application claims the benefit of U.S. Provisional Patent Application No. 61/983,222, filed Apr. 23, 2014 the disclosure of which is hereby incorporated herein in its entirety by reference.

BACKGROUND

An infinite variety of items are stored in drawers and similar compartments which come in a vast array of sizes and arrangements. The task of organizing items in drawers and maintaining such organization has been attempted time and again, however each has its own drawbacks. Many drawer organizers include selectively configurable dividers or walls that couple together and/or to a base.

For example, U.S. Pat. No. 4,693,382 to Galen discloses a sorter for automotive glove compartments that includes a lattice-like grid for construction of shelves and dividers. The grid can be fractured at preferential sites to form shelves and dividers of desired dimensions. Shelves and dividers are coupled together using clips with hooked portions that engage around members of the grid or that provide slots into which a shelf or divider can be inserted.

U.S. Pat. No. 7,703,866 to Benz et al. describes an article support divider system that includes a base and divider members with a matrix of openings. Supporting members are provided to couple the dividers to the base. The supporting members include a lower portion that is sized to be press-fit into the openings of the base and an upper portion that includes a slot for receiving the divider therein.

U.S. Patent Application Publication No. 2001/0035385 to Sosso describes a display rack with interlocking dividers that engage a base. The base includes a plurality of apertures or slots that are engaged by studs or clips extending from one or more of the dividers.

French Patent Application Publication No. FR 2303722 to Injelec S. A. describes an organizer system that includes a base with upwardly extending exterior walls and a bendable customizable partition. The partition has thinned sections spaced along its length about which the partition can be bent. The partition also includes studs extending from a bottom edge thereof that engage apertures in the base to retain the partition in a desired position.

U.S. Patent Application Publication No. 2012/0205335 to Abdullahi describes compartmentalization panels that can interlock with one another via corresponding male studs and female slots disposed at ends of the panels and along the faces of the panels.

U.S. Pat. No. 5,553,710 to Takama describes an article tray with a comb-toothed partition. The teeth of the partition extend upwardly and have a profile that when combined with the profile of an adjacent tooth form a dovetail slot. A mating dovetail tab on a second partition can be joined with the first partition by vertically engaging a selected one of the dovetail slots. The partition is flexible to enable curved configurations.

U.S. Pat. No. 8,397,937 to Preshke et al. describes a dividing system in which walls can be coupled orthogonally along their length. The walls include slots that extend parallel to the length of the wall. Connector members can be inserted into the slots and slid therealong to a desired location. The connectors include a pair of flanges arranged at a right angle such that one flange engages each of the walls to be joined. A hole is provided in each of the flanges to allow a screw to be secured through the flange and into the respective wall.

Each of these known solutions has drawbacks including complexity of installation, complexity in manufacturing a wide variety of components, limited customizability, difficult and bulky packaging for transport to and display on sales racks, low durability, and the like. There remains a need for a simple, highly customizable, drawer organizer system that provides a convenient packaging configuration as well as durable and sturdy base and partition arrangements.

SUMMARY

Embodiments of the invention are defined by the claims below, not this summary. A high-level overview of various aspects of the invention is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a drawer or other storage space organizer system that includes a base and partitions comprised of a flexible waffle mat and a plurality of connector assemblies.

The base and partitions are formed from a flexible sheet material, such as a foam rubber or similar material, or the base may be formed from a flexible material while the partitions are formed from a more rigid material, such as a plastic. The sheet material is configured in a grid or waffle pattern having a plurality of longitudinal and transverse members arranged perpendicularly to one another to form a plurality of grid spaces therebetween. The base is formed by cutting or otherwise forming a section of the sheet material to fit within the dimensions of a desired drawer or other storage space. The partitions are similarly cut to a desired length. If the partitions are constructed from a more rigid material they might also be fractured or snapped into sections of a desired length. The partitions include a continuous, smooth top edge and opposite bottom edge includes a plurality of spaced apart tabs extending therefrom. The tabs are insertable into the grid spaces of the base to couple the partition to the base.

The partitions can be coupled together at junctions therebetween using the connector assemblies. The connector assemblies include an L-shaped, corner member that has receptacles configured to engage the grid spaces of the partitions to be coupled. Locking plates that include studs configured for receipt by the receptacles are installed on each of the partitions at the junction to capture the partitions between the locking plates and the corner member. The studs interlock with the receptacles to maintain the joint. Thereby the connector assemblies couple the partitions and reinforce the assembly. Pairs of locking plates can also be employed to join the partitions end-to-end by coupling together form opposite faces of the partitions.

The flexibility of the base and partitions facilitates packaging of the components as a set. The base and partitions can be stacked and rolled up together for packaging or the like. The connector assemblies can also be included in the rolled up set.

DESCRIPTION OF THE DRAWINGS

Illustrative embodiments of the invention are described in detail below with reference to the attached drawing figures, and wherein.

DETAILED DESCRIPTION

Figure 1:
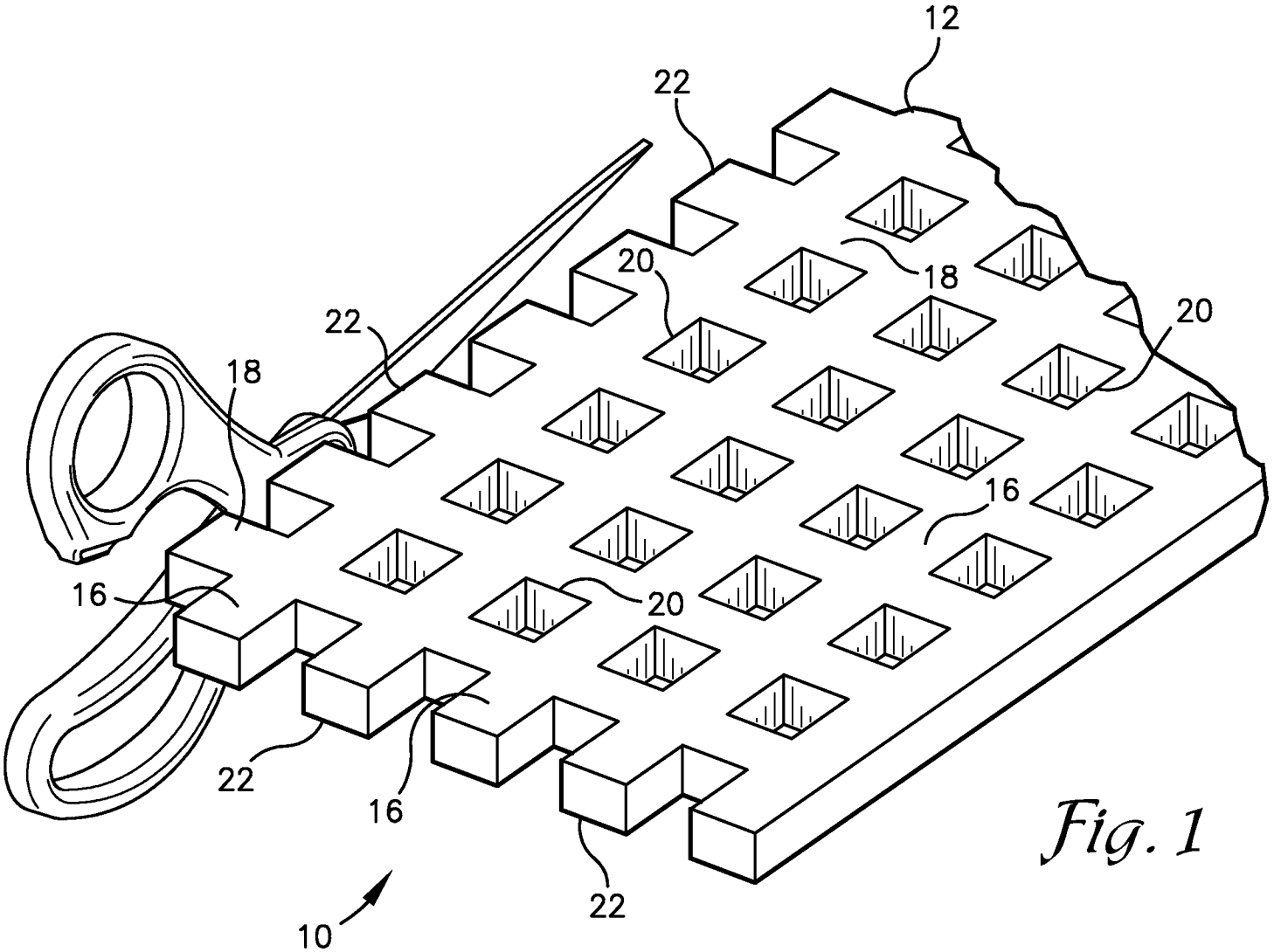
FIG. 1 is a perspective view of a drawer organizer depicting a base or partition of the organizer being cut to size in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

With reference to FIGS. 1-6, a drawer organizer 10 is described in accordance with an embodiment of the invention. The drawer organizer 10 is described herein with respect to use thereof in a drawer, such as in cabinetry or furniture, but the drawer organizer 10 is not so limited. The drawer organizer 10 might be employed in any form of compartment, including for example, tackle boxes, tool chests, and vehicle compartments, among others. The drawer organizer 10 might also be employed without disposal in a compartment, such as on a countertop or desktop or on a floor surface. Embodiments of the drawer organizer 10 might be embodied on various scales or sizes to accommodate the items desired to be stored therein, e.g. a floor organizer for storing toys may be constructed of much larger dimensions than an organizer 10 configured for disposal in a drawer.

The drawer organizer 10 includes a base 12 and a plurality of partitions 14. The base 12 and the partitions 14 are preferably constructed from the same material—a generally flexible and resilient foam, rubber, or plastic material. In an embodiment, the material is an elastomeric bioplastic such as TERRATEK FLEX from Green Dot Holdings, LLC. of Cottonwood Falls, Kans. The base 12 and partitions 14 might alternatively be constructed from dissimilar materials without departing from the scope of embodiments of the invention described herein. For example, the base 12 may be formed from a generally flexible material while the partitions 14 are constructed from a more rigid material such as a plastic, metal, composite, or the like.

The base 12 and partitions 14 comprise planar sections configured in a grid or waffle pattern. The waffle pattern includes a plurality of parallel, spaced-apart longitudinal members 16 that intersect a plurality of parallel, spaced-apart transverse members 18 to form a matrix of openings or grid spaces 20 therebetween. The grid spaces 20 are preferably evenly spaced apart in a regular pattern but may be randomly or otherwise distributed across the base 12 and/or partitions 14. The longitudinal and transverse members 16, 18 may extend from the perimeter of the base 12 and partitions 14 to form a plurality of tabs 22, or an outermost longitudinal or transverse member 16, 18 running parallel to the perimeter may form a smooth or straight edge at the perimeter. The tabs 22 may be provided about the entire perimeter of the base 12 and partitions 14 or may be provided along only a portion thereof. The partitions 14 preferably include the tabs 22 along a bottom edge but have smooth top and end edges.

The longitudinal and transverse members 16, 18 and the tabs 22 formed thereby are dimensioned and spaced apart to form the grid spaces 20 and to correspond with the dimensions and shape of the grid spaces 20. Accordingly, the tabs 22 can be inserted into and removably retained in the grid spaces 20. In one embodiment, the grid spaces 20 have dimensions that are slightly smaller than those of the tabs 22 to aid retention of the tabs 22 in the grid spaces 20 by friction-fit.

The base 12 and the partitions 14 can be provided as a single sheet of waffle material that is cut, sheared, or otherwise separated into the base 12 and partitions 14. Or separate sections of waffle material can be provided with predetermined dimensions, e.g. a large section of waffle material might be provided for the base 12, while strips of waffle material having a predetermined height or width might be provided for use as the partitions 14. The dimensions of both the base 12 and the partitions 14 are customizable to fit a desired application by cutting, shearing, fracturing, or otherwise cropping the waffle material to fit within a selected drawer 24 or other compartment.

Figure 4:
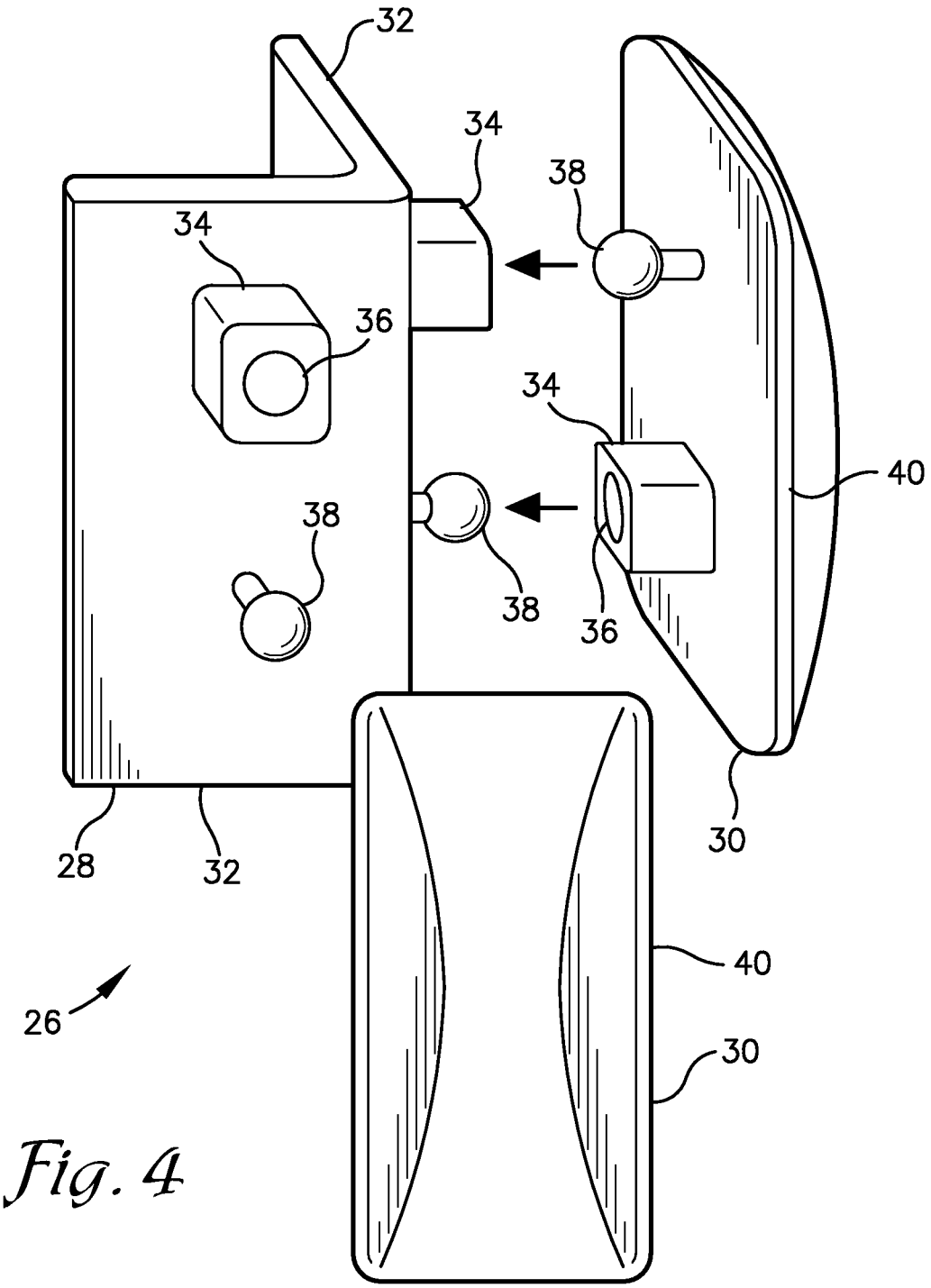
FIG. 4 is a perspective view of a connector assembly comprised of an inner corner member and a pair of locking plates depicted in accordance with an embodiment of the invention.

With reference to FIGS. 4 and 5, the drawer organizer 10 also includes a plurality of connector assemblies 26. Each connector assembly 26 includes an L-shaped corner piece 28 and a pair of locking plates 30. The corner piece 28 is comprised of a pair of flanges 32 that extend generally perpendicularly to one another. In other embodiments, the flanges 32 might be arranged at non-right angles to one another. The corner piece 28 may be configured as an inside corner as depicted in the drawings or may be configured as an outside corner.

Each flange 32 is dimensioned with a width sufficient to extend across at least the width of one longitudinal member 16 and one grid space 20. The width of the flange 32 is preferably sufficient to extend across the width of two adjacent longitudinal members 16 and the grid space 20 formed therebetween. The height of the flanges 32 is sufficient to extend across at least one transverse member 18 and one grid space 20, or, as depicted in FIG. 4, the height is sufficient to extend across at least three transverse members 18 and two grid spaces 20 formed therebetween. The height of the flanges 32 may configured as a function of the height of the partitions 14 to be employed in a given application, e.g. the flanges 32 may be dimensioned with a height equal to or just less than that of the partition 14. Similarly, the width of the flanges 32 can be increased to provide additional support to the partitions 14 as desired.

One or more receptacles 34 are provided on each flange 32 and extend from the respective flange 32 toward a partition 14 to be joined by the connector assembly 26. The receptacles 34 are dimensioned and located on the flanges 32 for insertion into the grid spaces 20 of the partitions 14 to be joined. The exterior form and dimensions of the receptacles 34 may be configured to correspond with that of the grid spaces 20 to provide friction-fit or tight engagement therebetween. An aperture 36 is provided in each receptacle 34 and is configured to receive a respective stud 38 disposed on the locking plates 30. The studs 38 can interlock with the apertures 36 in any desired manner, such as friction-fit or snap-fit, among others and can form a releasable coupling or a permanent coupling therebetween.

The locking plates 30 include a body 40 with a substantially planar face from which the studs 38 extend. The body 40 can have any dimensions, but preferably is dimensioned to correspond with the dimensions of a respective flange 32 of the corner piece 28. As shown in FIG. 4, the studs 38 include a spherical head on a distal end of a rod for engagement with a mating structure in the aperture 36 in a snap-fit configuration, but one of skill in the art will recognize other possible configurations that perform a similar function; such configurations are understood as falling within the scope of embodiments of the invention described herein.

Figure 5A:
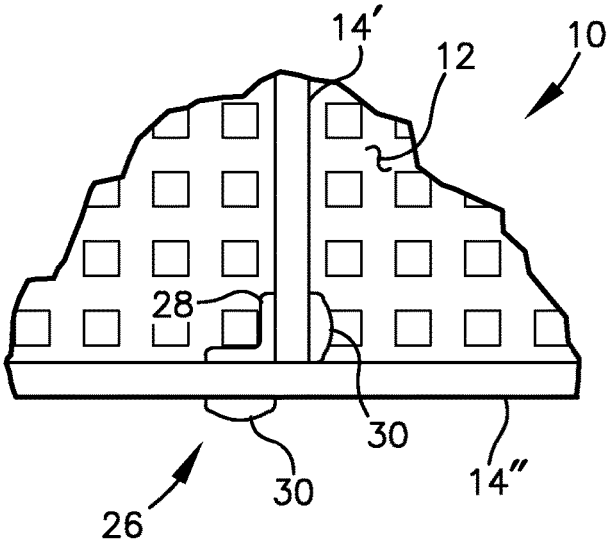
FIGS. 5A-C are top plan views of joint configurations of a drawer organizer depicted in accordance with an embodiment of the invention.
Figure 5B:
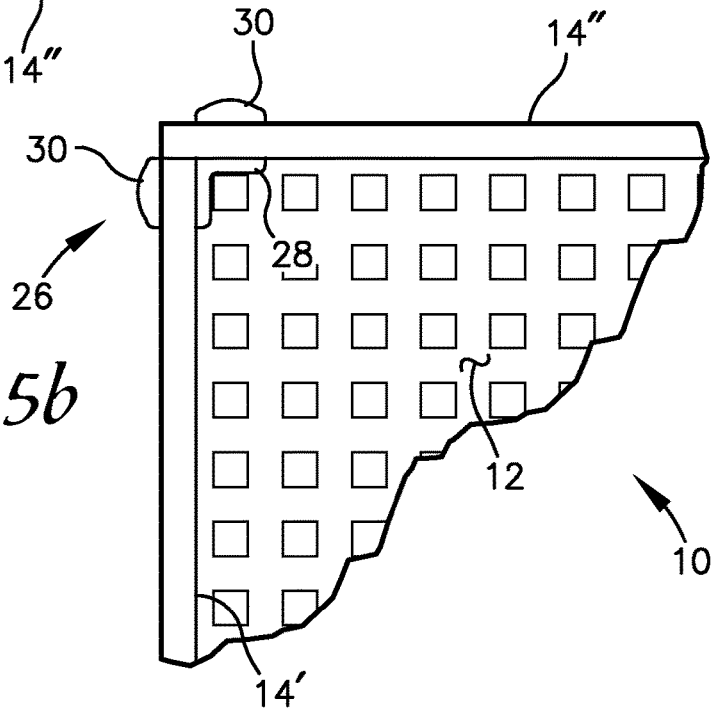
Figure 5C:
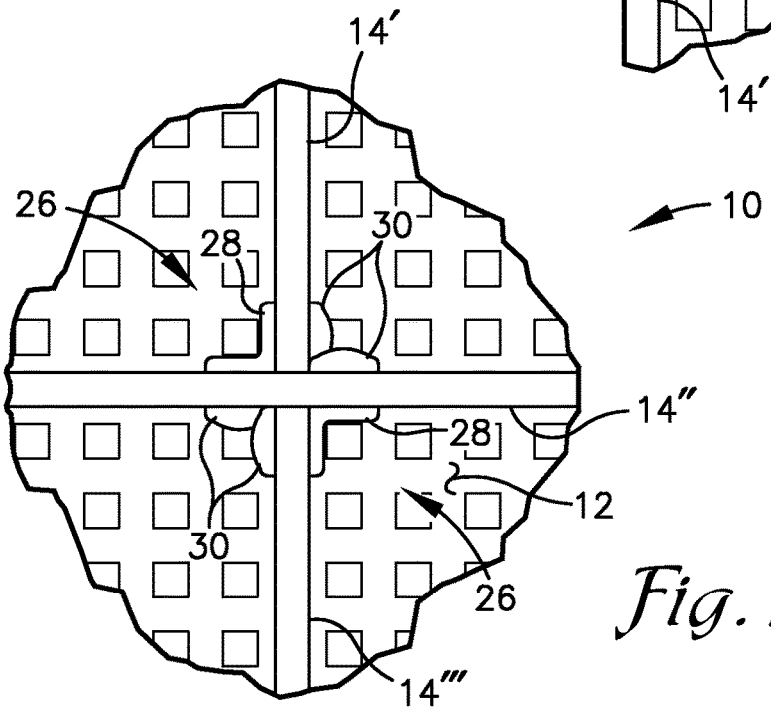

The connector assemblies 26 can be employed to join the partitions 14 in a variety of configurations, as depicted in FIGS. 5A-C. For example, a first partition 14' can be joined to a second partition 14" along the length thereof to form a "T" joint as shown in FIG. 5A, or the first and second partitions 14', 14" can be joined at their ends to form a corner or an "L" joint (FIG. 5B). A third partition 14'" might also be joined to the second partition 14" at a location corresponding to and opposite from the first partition 14' to form an "X" joint, as shown in FIG. 5C; the "X" joint might also be formed by the intersection of four partitions 14. In other embodiments, the connector assemblies 26 enable joining the partitions 14 at non-right angles.

As depicted in FIG. 4, each flange 32 and each locking plate 30 preferably includes one receptacle 34 and one stud 38. As such, the locking plates 30 can be coupled to the corner piece 28 to couple the partitions 14 at an angle relative to one another as described above, or pairs of the locking plates 30 can be coupled together in opposite orientations (e.g. with the stud 38 and receptacle 34 of one locking plate 30 aligned with the receptacle 34 and the stud 38, respectively, of the second locking plate 30) to join the partitions 14 end-to-end. The locking plates 30 may be disposed to extend across abutted or adjacent ends of two partitions 14 and positioned on opposing surfaces of the partitions 14 to capture the partitions 14 between the locking plates 30.

Figure 7:
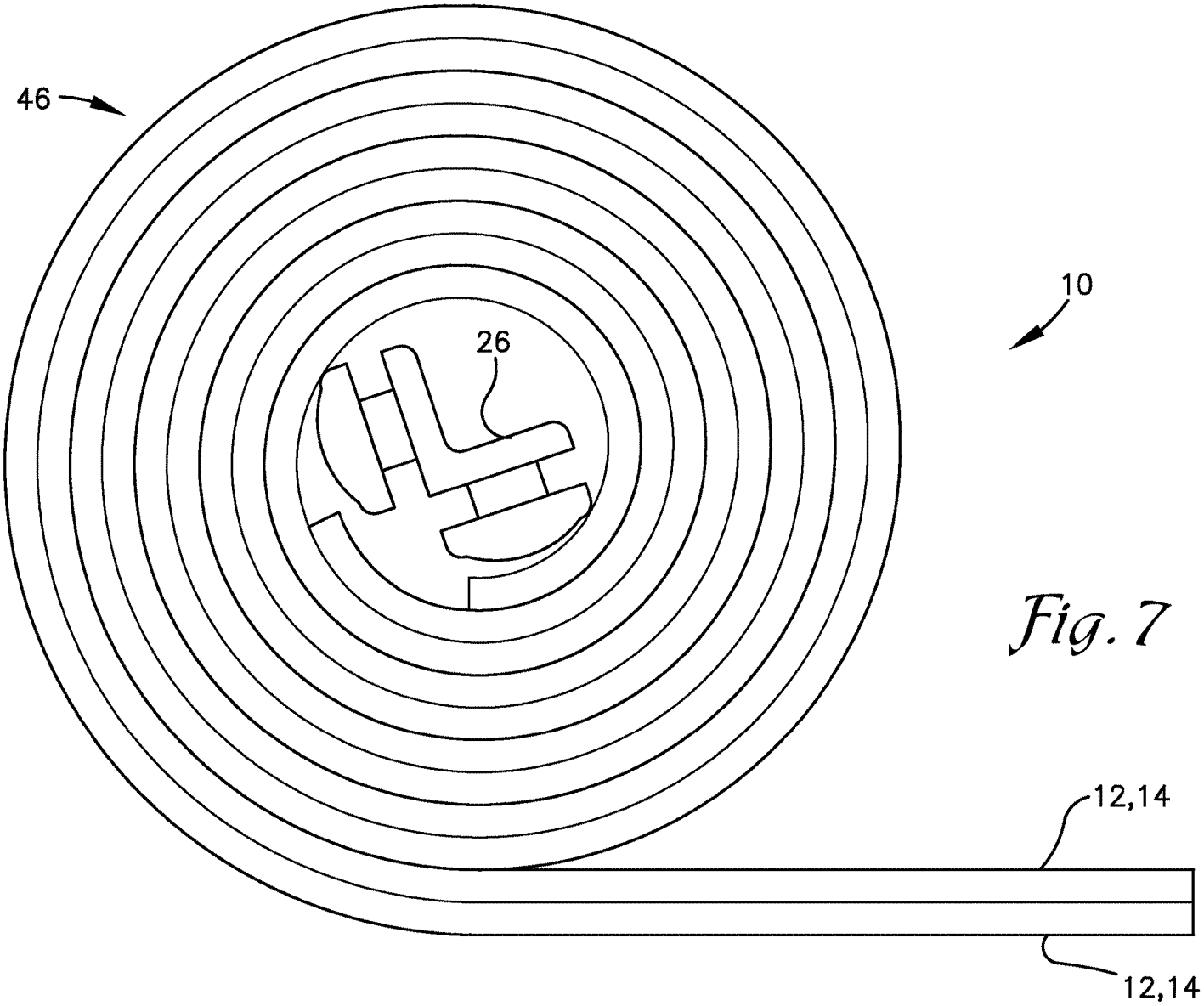
FIG. 7 is an end view of a drawer organizer rolled up for packaging and shipping in accordance with an embodiment of the invention.

With additional reference to FIG. 7, the packaging of the drawer organizer 10 is described in accordance with an embodiment of the invention. The flexibility of the materials employed for the base 12 and the partitions 14 allows the base 12 and partitions 14 to be stacked and rolled into a tube-like form. A plurality of the connector assemblies 26 can also be included in the rolled-up configuration; the connector assemblies 26 can be positioned in the center of the roll or can be positioned at one or more positions within the roll as desired.

As described previously, the base 12 and the partitions 14 can be provided as one or more larger sheets of waffle material to be cut to desired dimensions, or the partitions 14 can be precut and separate from the base 12. In either case, the sections of waffle material are arranged in a stacked arrangement (or placed end-to-end) and rolled onto themselves to capture all of the components of the drawer organizer 10 within a convenient rolled-up tubular form that can be bound, labeled, and/or inserted into additional packaging for transport, sale, or storage. In embodiments in which the partitions 14 are formed from a more rigid material, the partitions 14 may be rolled up in the base 12 along with the connector assemblies 26. As such, all components of the drawer organizer 10 can be packaged and provided as a kit 46.

Figure 2:
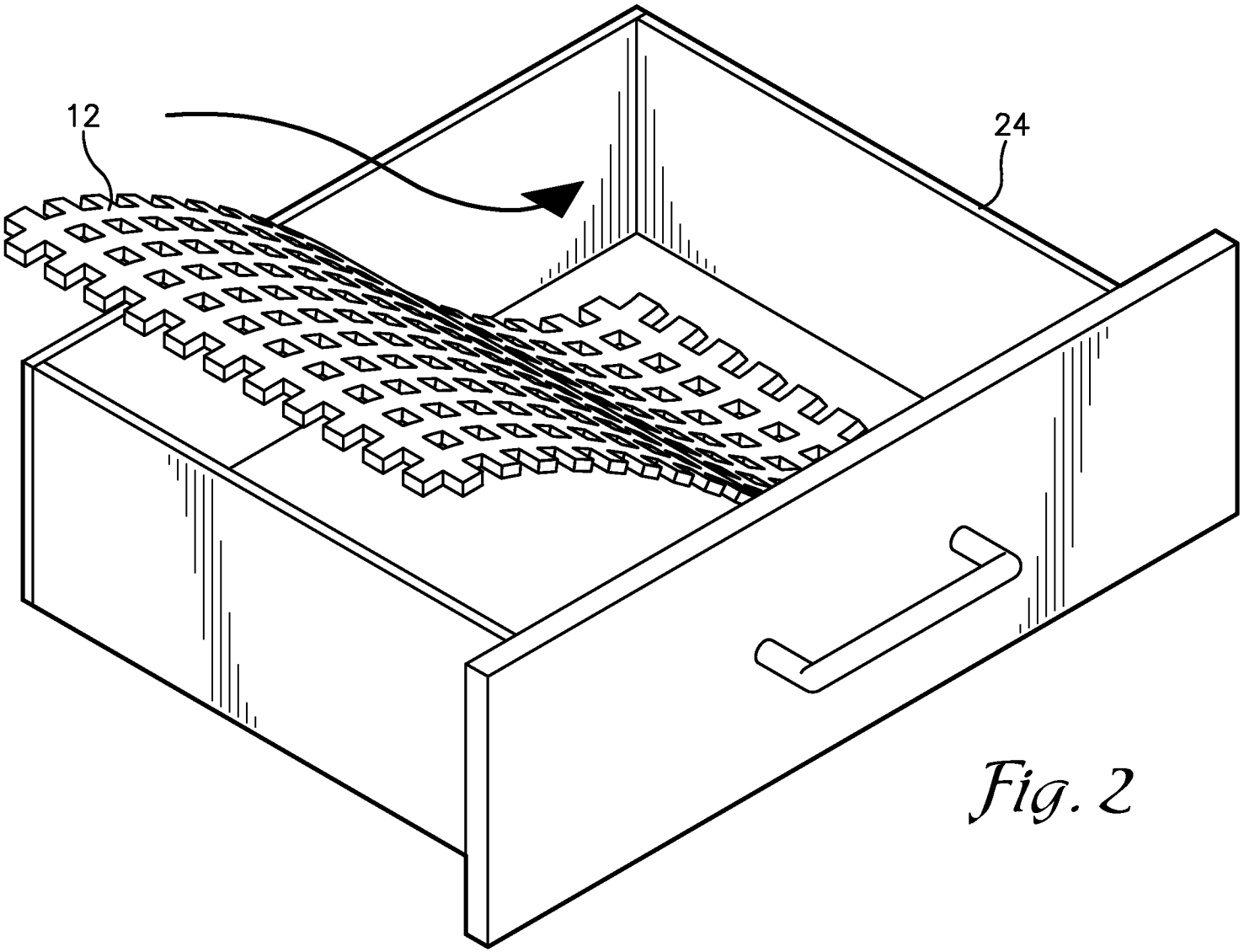
FIG. 2 is a perspective view of a base of a drawer organizer being disposed in a drawer in accordance with an embodiment of the invention.
Figure 3:
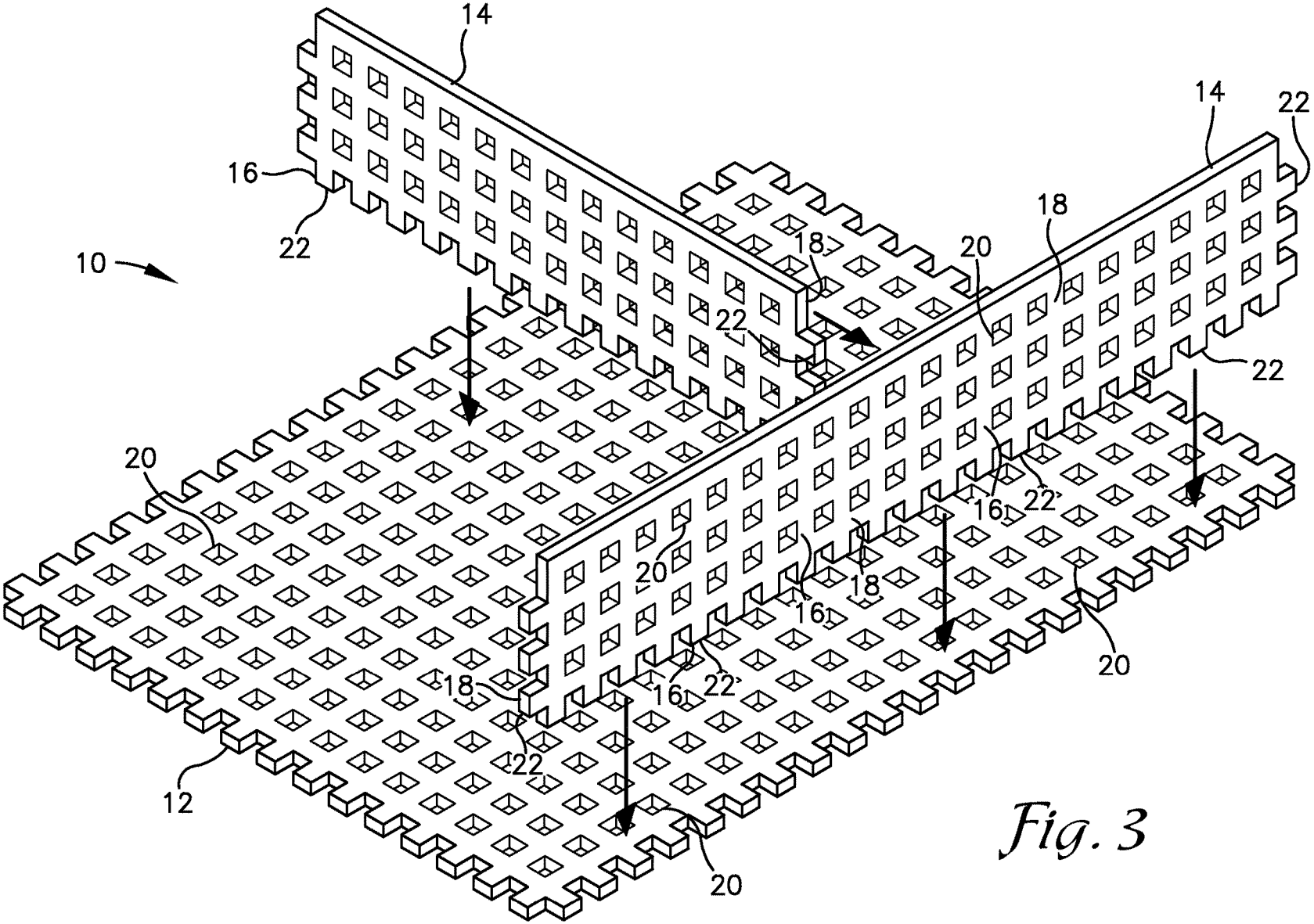
FIG. 3 is a perspective view of partitions of a drawer organizer being installed onto a base in accordance with an embodiment of the invention.

With continued reference to FIGS. 1-6, the installation of the drawer organizer is described in accordance with an embodiment of the invention. The base 12 is preferably provided having dimensions greater than that required for most standard drawer 24 sizes or in a custom size defined by the drawer 24 or other intended application. The base 12 is prepared for insertion into the drawer 24 by cutting, shearing, or otherwise sizing the base 12 to fit within the dimensions of the drawer 24. As shown in FIG. 1, the waffle material may be configured to enable cutting with a standard pair of scissors, a knife, or similar household item. The base 12 can be sized to extend across the entirety of the drawer bottom or can be fit within a smaller portion of the drawer 24. When properly sized, the base 12 can be inserted into the drawer 24 as shown in FIG. 2.

The partitions 14 are next fitted to the drawer organizer application. The partitions 14 can be provided in predetermined lengths or can be cut to desired lengths in a manner similar to that as described above for the base 12. When the partitions 14 are formed from a more rigid material, such as a plastic, the partitions 14 may be cut to size in a manner similar to that of the base 12 or may be fractured at a desired location. Predefined fracture points may be formed into the partitions 14 to aid breaking or fracturing thereof. In some applications, the height of the partitions 14 might also customizable by cutting the partitions to desired heights, e.g. partitions 14 of greater heights might be desired/provided for deeper drawers 24 or the partitions 14 might be cut down for shallower drawers 24.

Figure 6:
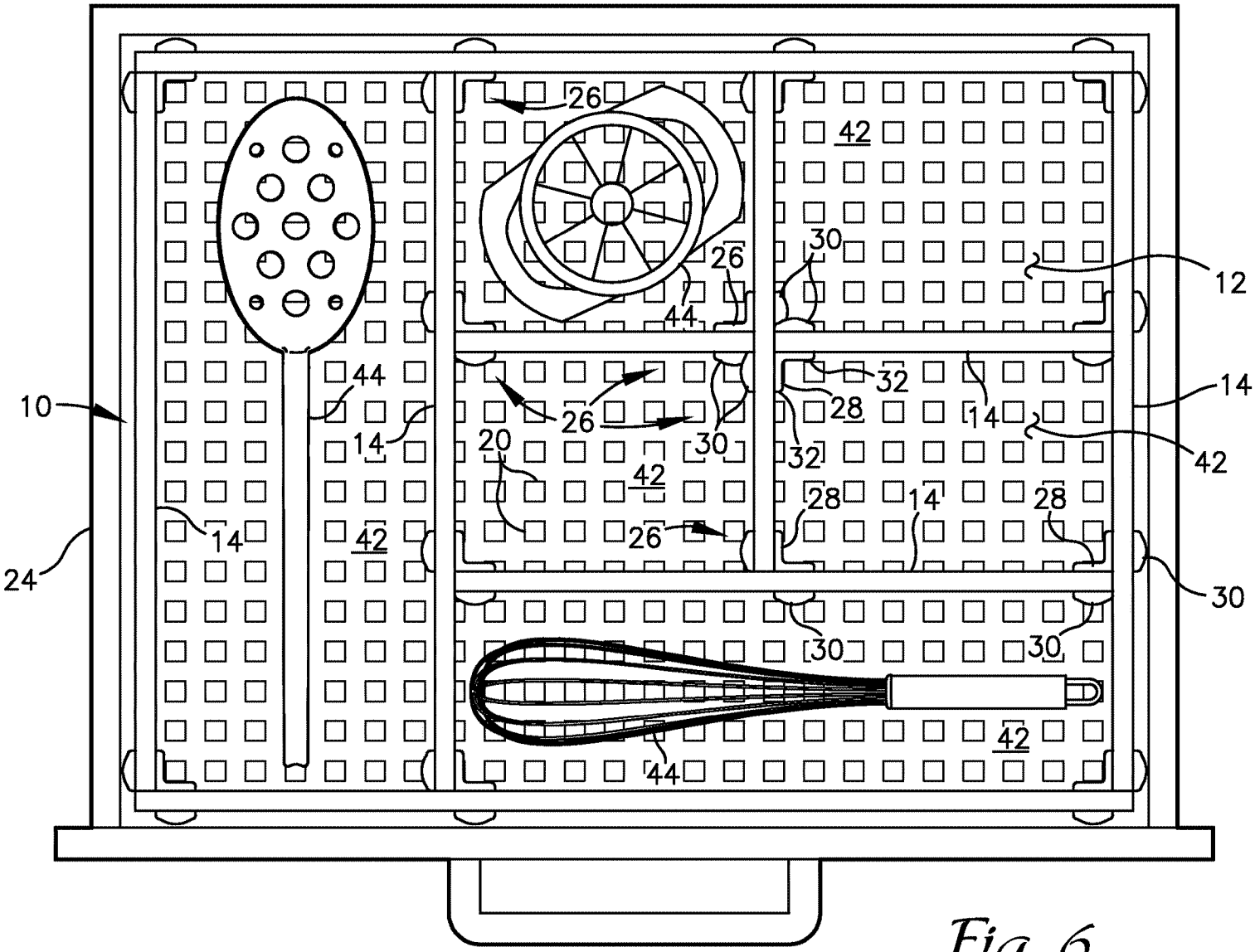
FIG. 6 is a top plan view of a drawer organizer disposed in a drawer in accordance with an embodiment of the invention.

The partitions 14 can be arranged in any desired arrangement on the base 12 to provide a desired number and arrangement of compartments 42, as depicted in FIG. 6. In some embodiments, it may be beneficial to arrange one or more partitions 14 about the perimeter of the base 12 to form a frame around the base 12; such may aid to reinforce the overall drawer organizer assembly, but is not required. The tabs 22 on the bottom edge of the partitions 14 are inserted into the grid spaces 20 of the base 12 in the desired location for the partition 14. Similarly, the tabs 22 may be provided on the ends of a first partition 14 which can be inserted into the grid spaces 20 of a second partition 14 where the first and second partitions 14 form a junction or joint. Alternatively, the tabs 22 of a first partition 14 and/or a second partition 14 may be trimmed such that abutting end faces of one or both of the partitions 14 are smooth or non-interlocking.

The connector assemblies 26 can be installed at the junctions of the partitions 14 to retain the position of the partitions 14 and to reinforce the partitions 14. In some embodiments, the assembly of the partitions 14 and the base 12 using the tabs 22 and the grid spaces 20 is sufficient to retain the drawer organizer 10 in a desired configuration. The connector assemblies 26 may also be employed to couple the one or more of the partitions 14 to the base 12.

The connector assemblies 26 are installed by placing the corner piece 28 on an inside corner of the junction between two partitions 14 and inserting the receptacles 34 and/or studs 38 into the appropriate grid spaces 20 of the partitions 14. The fit between the receptacles 34 and the grid spaces 20 may aid to retain the partitions 14 in engagement therewith while the installer prepares to install the locking plates 30.

A locking plate 30 is disposed on a side of the partition 14 opposite the corner piece 28. The studs 38 of the locking plate 30 and/or the corner piece 28 are aligned with and inserted into the apertures 36 of the receptacles 34 to form a snap-fit, friction-fit, or other form of connection therebetween. The second locking plate 30 is similarly affixed to the remaining flange 32 of the corner piece 28. As such, the partitions 14 are captured between the corner piece 28 and the locking plates 30.

A plurality of additional partitions 14 and connector assemblies 26 can be installed to form various compartments 42. The partitions 14 may be placed at right angles to one another and with the partitions 14 extending linearly. Or the connector assemblies 26 may be configured to enable one or more of the partitions 14 to extend at non-right angles to one another. Additionally, partitions 14 comprised of a flexible material may be disposed in a non-linear or curvilinear fashion on the base 12 to form non-cuboidal compartments 42. Upon completion, a variety of items 44 can be placed into the compartments 42 and retained therein to provide and maintain the items in an organized manner within the drawer 24.

The construction and configuration of the drawer organizer 10 provides a variety of benefits. For example, the grid spaces 20 in the base 12 allow dirt and debris to fall to the drawer bottom and away from the items 44. Additionally, the flexibility and resilience of the waffle material forming the base 12 and the partitions 14 protect the items 44 placed therein from hard contact with the drawer bottom and with other items 44 stored in other compartments 42. When it is desired to store items 44 of different sizes in the drawer 24, the drawer organizer 10 can be easily reconfigured by removing one or more of the connector assemblies 26 and altering, removing, or replacing one or more of the partitions 14.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to demarcate those structures as including a plurality of possible arrangements or designs within the scope of this disclosure and readily identifiable by one of skill in the art to perform the particular function in a similar way without specifically listing all such arrangements or designs. Certain features and sub-combinations are of utility and may be employed without reference to other features and sub-combinations and are contemplated within the scope of the claims.

What is claimed is:

1. A storage space organizer comprising:

a base formed from a flexible material, the base comprising a plurality of longitudinal members and a plurality of transverse members, wherein said longitudinal and transverse members form a horizontal waffle pattern of openings, said horizontal waffle pattern of openings including linear series of openings;

a first partition comprising a plurality of longitudinal members and a plurality of transverse members, wherein each of the first partition's transverse members has a downwardly extending lower end, and wherein the first partition's longitudinal and transverse members form a vertical waffle pattern of openings; and a second partition comprising a plurality of longitudinal members and a plurality of transverse members, wherein each of second partition's transverse members has a downwardly extending lower end, and wherein the second partition's longitudinal and transverse members form another vertical waffle pattern of openings; wherein the downwardly extending lower ends of the first partition's transverse members engage one of the linear series of openings of the base and wherein the downwardly extending lower ends of the second partition's transverse members engage another linear series of openings of the base.

2. The storage space organizer of claim 1, wherein the first and the second partitions are formed from the flexible material that forms the base.

3. The storage space organizer of claim 1, wherein the base and the first and second partitions are configured for cutting to desired dimensions using household tools.

4. The storage space organizer of claim 1, wherein the base and the first and second partitions are rolled up in a tubular form for packaging, shipping, or transport.

5. The storage space organizer of claim 1, wherein the base, the first partition, and the second partition are provided as a single section of the flexible material, the single section of the flexible material being cut using household tools to form the base, the first partition, and the second partition.

6. The storage space organizer of claim 1, wherein the first partition and the second partition are formed from a substantially rigid material.

* * * * *